United States Patent [19]

Hasili

[11] Patent Number: 4,464,611

[45] Date of Patent: Aug. 7, 1984

[54] LINE CATHODE HEATING AND PROTECTION CIRCUIT

[75] Inventor: Jacob P. Hasili, Hamilton Township, Mercer County, N.J.

[73] Assignee: RCA Corporation, New York, N.Y.

[21] Appl. No.: 525,494

[22] Filed: Aug. 22, 1983

[51] Int. Cl.[3] ..... H01J 29/70; H01J 29/72

[52] U.S. Cl. ..... 315/366; 313/422

[58] Field of Search ..... 315/366, 411, 94, 383; 313/422, 409, 411; 328/270; 358/10; 324/404

[56] References Cited

U.S. PATENT DOCUMENTS 3,961,241 6/1976 Goldstein et al. ..... 358/10

4,167,690 9/1979 Gange ..... 315/366

*Primary Examiner*—Theodore M. Blum

*Assistant Examiner*—Gregory Issing

*Attorney, Agent, or Firm*—Eugene M. Whitacre; Dennis H. Irlbeck; Lester L. Hallacher

[57] ABSTRACT

A circuit for pulse heating a line cathode also protects the cathode from voltage and current surges. An adjustable voltage regulator provides a regulated voltage to a pulse generation circuit. The voltage regulator has a control input which is used to control the regulator output. The voltage on the control electrode is controlled by a control circuit which is actuated by a logic circuit. The logic circuit and the pulse generator are responsive to the horizontal synchronization pulses of the display device containing the line cathode.

6 Claims, 2 Drawing Figures

LINE CATHODE HEATING AND PROTECTION CIRCUIT

BACKGROUND OF THE INVENTION

This invention relates generally to cathode heating circuits and particularly to a circuit for directly heating a line cathode and for protecting the cathode from voltage and current surges.

U.S. Pat. No. Re. 30,195 to C. H. Anderson et al. discloses a guided beam flat display device having a diagonal dimension of approximately 127 cm. The horizontal dimension of the display device, therefore, is approximately 101.6 cm, and the vertical dimension is approximately 76.2 cm. The faceplate and backplate of the display device are supported against collapse due to atmospheric pressure by a plurality of vertically extending internal support walls which also divide the display device into a plurality of vertically extending channels. A screen, which luminesces when struck by electrons, is arranged on the internal surface of the faceplate. A visual display is generated by propagating electron beams in all of the channels and simultaneously deflecting the electron beams toward the phosphor screen. While traveling toward the screen, the electron beams are horizontally scanned across the channels so that each channel provides a portion of each total horizontal line. Details of flat panel display devices which operate in this manner are described in U.S. Pat. No. 4,117,368 to F. J. Marlowe et al. and U.S. Pat. No. 4,131,823 to T. L. Credelle. The electrons for all the channels are provided by a line cathode which extends across the entire horizontal dimension of the display device.

U.S. Pat. No. 4,167,690 to R. A. Gange describes a structure and operational method for a line cathode designed for use in flat panel display devices of the type described hereinabove. In the patented method, heating pulses having a 10 μsec pulse width are applied to the cathode at uniformly spaced intervals of approximately 50 μsec. Thus, the cathode is heated by the 10 μsec heating pulses and cools during the 50 μsec period between the pulses. Current is extracted from the cathode of propagation along the channels during the 50 microsecond cooling periods.

In the operation of the display device, the horizontal scan lines are sequentially generated at the appropriate vertical positions during the cooling period when current is extracted from the cathode. The vertical stepping on the screen and horizontal beam scanning are synchronized by the use of horizontal synchronization pulses. The heating pulses are applied to the cathode during the horizontal retrace time when no display is generated and thus the heating pulses also are synchronized with the horizontal synchronization pulses of the display device.

The method of operating a line cathode described in Gange Patent is satisfactory for the purposes intended. However, a line cathode is very sensitive and thus is subject to failure due to several potential problems. For example, if the horizontal synchronization pulses should cease, or if several sequential pulses should be missing, the voltage applied to the cathode should be substantially reduced. Also, when the display device is initially turned on, the voltage applied to the cathode should be very low, or zero, to prohibit voltage surges from damaging the cathode. Also, it is important for the operating voltage applied to the cathode to have risen to the full operating level before allowing any heating pulses to be applied to the cathode.

The present invention is directed to a circuit which provides heating pulses to a line cathode in synchronization with the horizontal sync pulses and which protects the cathode from failure occasioned by the above identified potential problems.

Summary

A protection and pulse heating circuit for a line cathode in a flat panel display device includes an adjustable voltage regulator for providing a regulated output voltage. The adjustable voltage regulator includes a control input lead which is used to regulate the output voltage of the supply. A control circuit controls the voltage on the control input lead. A logic means actuates the control circuit in response to the horizontal synchronization pulses of the display device. A pulse generator is responsive to the regulated output voltage and the horizontal synchronization pulses whereby the pulse generator pulse heats the cathode in synchronization with the horizontal synchronization pulses.

DETAILED DESCRIPTION

Figure 1:
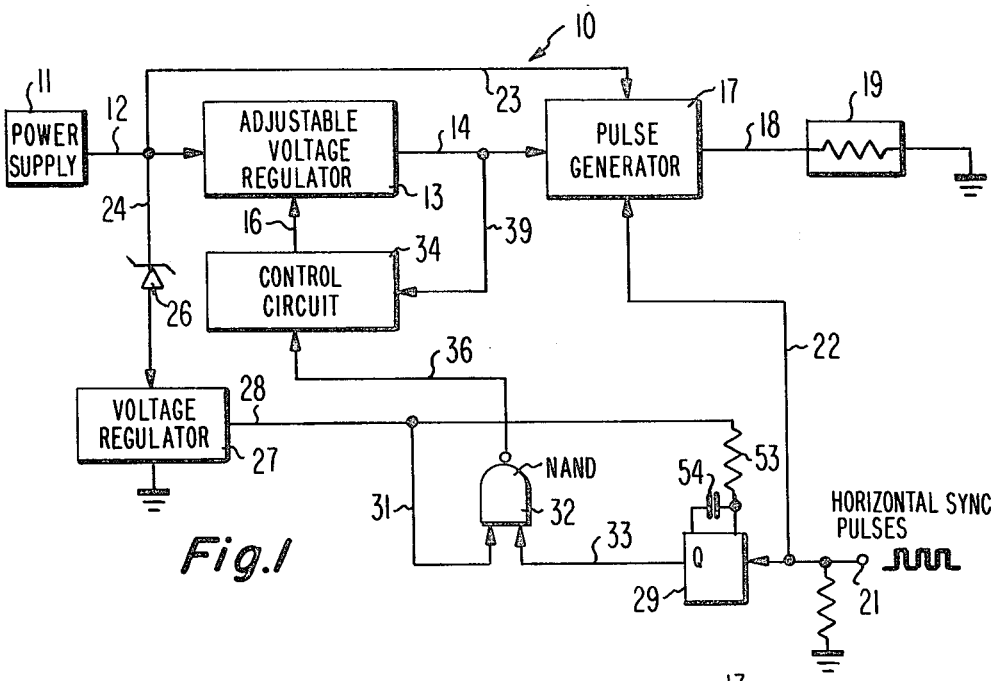
FIG. 1 is a block diagram of a preferred embodiment.

In FIG. 1, a line cathode pulse heating and protection circuit 10 includes a standard commercially available power supply 11. The power supply 11 provides an unregulated DC voltage, such as 24 volts, on an output line 12. The DC output voltage available on the output line 12 serves as an input voltage to an adjustable voltage regulator 13. The output of the adjustable voltage regulator 13 appears on an output line 14 as a DC voltage regulated at the desired level of operation, such as 18 volts DC. The adjustable voltage regulator 13 includes a control input lead 16 which is used to regulate the output voltage on the output lead 14. The output voltage on the output lead 14 is applied as an input to a pulse generator 17. The horizontal synchronization pulses of a display device are applied to an input terminal 21 and to the pulse generator 17 by way of a line 22. The unregulated DC voltage output of the power supply 11 is also applied to the pulse generator 17 by way of a line 23. The pulse generator 17 generates 10 μsec heating pulses in synchronization with the horizontal sync pulses and these pulses are applied by an output line 18 to a line cathode 19 of the display device.

The unregulated voltage output of the power supply 11 also is applied to a voltage regulator 27 by way of a lead 24 and a zener diode 26. The zener diode 26 maintains the input to the voltage regulator 27 at a constant level, such as 12 volts. The output of the voltage regulator 27 is a regulated voltage, for example 12 volts DC, which is provided to an output line 28. The regulated voltage is applied to a retriggerable monostable multivibrator 29 and also, by way of a line 31, to one input terminal of a NAND Gate 32. The other input of the NAND Gate 32 is coupled by a line 32 to the Q output of the multivibrator 29. The output of the NAND Gate 32 is coupled by a line 36 to the input of a control circuit 34. The output of the control circuit 34 is coupled to the control input lead 16 of the adjustable voltage regulator 13. The control circuit 34 contains voltage responsive avalanche discharge means and is used to control the output voltage of the adjustable voltage regulator 13 in a manner described with respect to FIG. 2.

In normal operation, the voltage regulator 27 is on and the input terminal of the NAND Gate 32 which is coupled to the regulator output by the lines 28 and 31 is high. The Q output of the monostable multivibrator 29 is high between the horizontal synchronization pulses. Under these conditions the output lines 36 of the NAND Gate 32 is low and the control circuit 34 allows the output of the adjustable voltage regulator 13 to rise to the operational level at a rate determined by an r-c network within the control circuit 34. The output of the adjustable voltage regulator 13 on the line 14 is applied to the pulse generator 17 and prepares the generator 17 for provision of a heating pulse to the cathode 19. When a horizontal synchronization pulse is received by the input terminal 21, the pulse generator is triggered and a heating pulse is applied to the cathode 19. The horizontal synchronization pulse which triggers the pulse generator 17 does not change the state of the Q output 33 of the multivibrator 29 because of the internal connections of the multivibrator 29, as explained hereinafter with respect to FIG. 2. The NAND Gate 32 output also remains unchanged. The control circuit 34 then increases the voltage on the control line 16 resulting in an increase in the voltage on the output line 14 and prepares the pulse generator for the next horizontal synchronization pulse.

If a failure occurs to either the power supply 11, the voltage regulator 27 or the adjustable voltage regulator 13 between horizontal synchronization pulses, or if a selected number (such as three) of the horizontal sync pulses are missing, one of the input terminals of the NAND Gate 32 will go low and the output of the NAND Gate 32 also goes high to prohibit the adjustable voltage regulator 13 from applying an operating voltage to the pulse generator 17.

Figure 2:
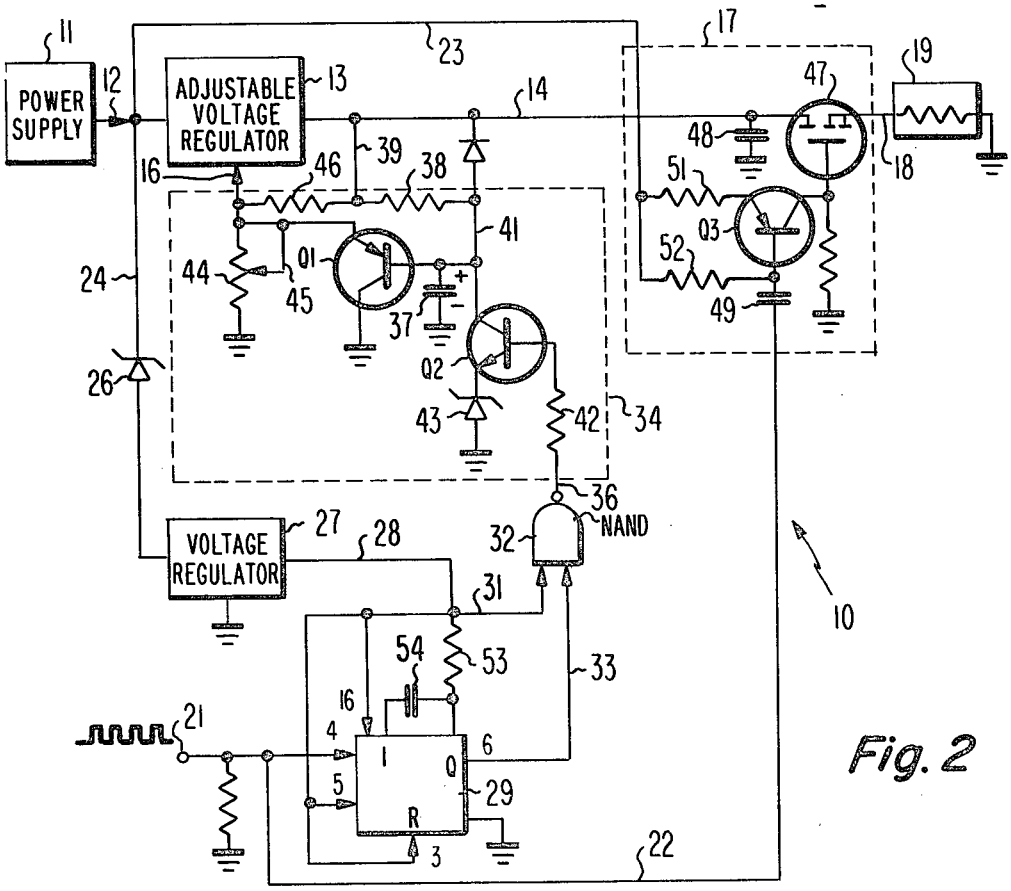
FIG. 2 shows the component parts of the block diagram of FIG. 1 in more detail.

The control circuit 34, the pulse generator 17 and the connections of the multivibrator 29 and NAND Gate 32 are shown in more detail in FIG. 2. The adjustable voltage regulator 13 is a commercially available circuit, such as a type LM338 available from Fairchild and other logic circuit suppliers. The output voltage on the line 14 is controlled by the voltage on the control input lead 16. However, because of the inherent operation of the circuit, when a voltage is available on the input lead 12, the output on the line 14 is never zero. Thus, when the voltage on the control input lead 16 is low, or zero, a current trickles through the regulator 13 and places a low output voltage on the output line 14. The control circuit 34 includes two transistors Q1 (PNP) and Q2 (NPN) which control the voltage applied to the control input lead 16. A capacitor 37 is coupled between the base of the transistor Q1 and ground. The high side of the capacitor 37 is coupled to the output line 14 of the adjustable voltage regulator 13 by way of a resistor 38 and lines 39 and 41. The low output voltage from the adjustable voltage regulator 13 charges the capacitor 37 and turns off the transistor Q1. The emitter of Q1 is coupled to a resistor 44 having an adjustment arm 45. The setting of the arm 45 establishes the maximum voltage on the resistor 44 and thus also establishes the maximum output of the regulator 13. The control input lead 16 is coupled to the adjustable resistor 44 and to the output line 14 by way of a resistor 46 and the line 39. The collector of the transistor Q2 is coupled to the base of the transistor Q1 and the base of the transistor Q2 is coupled to the output of the NAND Gate 32 by way of the line 36 and a resistor 42. The normally low output of the NAND Gate 32 turns transistor Q2 off. The emitter of the transistor Q2 is grounded through a zener diode 43. The output voltage on the line 14 is dependent upon the voltage applied to the control input lead 16. When the voltage on the control input lead 16 is zero, the output of the adjustable voltage regulator 13 is low, such as 5 volts. The capacitor 37 charges to raise the voltage at the junction of resistors 38 and 46 in a time determined by the values of resistor 38 and capacitor 37. The voltage to the control input lead 16 also raises at the same rate. As the voltage on the control input lead 16 increases, the regulated voltage available on the output line 14 also increases until the desired voltage (such as 18 volts) is obtained. Thus in normal operation, the voltage applied to the control lead 16 controls the output of the adjustable voltage regulator 13. When a failure occurs in either the power supply 11 or the voltage regulator 27, or if three consecutive horizontal synchronization pulses are missing, the two transistors Q1 and Q2 in conjunction with the logic circuitry including the NAND Gate 32 and the multivibrator 29 prevent the control input lead 16 from reaching the voltage necessary to raise the output line 14 to the operating potential in a manner more fully described hereinbelow.

The pulse generator 17 includes a field effect transistor 47 which, when triggered, applies a heating pulse to the cathode 19. The regulated voltage output available on the output line 14 charges a capacitor 48 to the level established by the setting of the arm 45 on the resistor 44. The pulse generator 17 includes a transistor Q3 the base of which is coupled to the input terminal 21 by way of a capacitor 49 and the line 22. The pulse generator 17, therefore, also receives the horizontal synchronization pulses. The output voltage of the unregulated power supply 11 available on the output line 12 is coupled by the line 23 to two resistors 51 and 52 which, respectively, are coupled to the emitter and base of the transistor Q3. The collector of transistor Q3 is coupled to the trigger electrode of the FET 47. When a horizontal synchronization pulse is received from the input terminal 21, the transistor Q3 goes conductive to trigger the FET 47 and discharge the capacitor 48 through the cathode 19 to heat the cathode 19. The resistors 51 and 52 raise the voltage level applied to the trigger electrode of the FET 47 from 12 volts to 18 volts, for example.

In normal operation, when the display device is initially turned on, the unregulated DC voltage output of the power supply 11 is applied to the adjustable voltage regulator 13, to the resistors 51 and 52 of the pulse generator 17 and also to the voltage regulator 27. At this time, both input terminals on the NAND Gate 32 are high and line 36 is low. The transistor Q2 therefore is turned off. The output of the adjustable voltage regulator 13 is very low because the voltage on the control input lead 36 is zero. However, the output voltage on the output line 14 begins to charge the capacitor 37 through the resistor 38 and the transistor Q1 is turned off. As capacitor 37 charges the voltage on the input control lead 16 increases and increases the output voltage on the output lead 14. The capacitors 37 and 48 therefore are charged as the output of the adjustable voltage regulator 13 increases. However, the FET 47 and the transistor Q3 are nonconductive and, therefore, the cathode 19 is not energized. Accordingly, the cathode 19 is protected from any voltage surges which occurred when the system was turned on.

When a horizontal sync pulse is received on the input terminal 21, the transistor Q3 is turned on to trigger the FET 47 and discharge capacitor 48 through the cathode 19 and thereby apply one heating pulse to the cathode. The horizontal synchronization pulse does not change the Q output of the multivibrator 29 because of the internal connections. Accordingly, the output of the NAND Gate 32 and the states of the transistors Q1 and Q2 remain unchanged. Upon cessation of the synchronization pulse, the FET 47 is turned off and the output line 14 raises in voltage level to recharge capacitor 48 in preparation for the next horizontal synchronization pulse.

The multivibrator 29 is internally connected in a manner to detect the absence of three consecutive horizontal sync pulses, as shown by the pin connections in FIG. 2. A resistor 53 and a capacitor 54 are selected to have an r-c time constant which slightly exceeds the time duration between three consecutive horizontal synchronization pulses. Each horizontal synchronization pulse resets the multivibrator 29 and the Q output would ordinarily change state for each pulse. However, the capacitor 54 is coupled to internal circuitry of the multivibrator 29 to recharge each horizontal pulse. Between pulses the capacitor 54 discharges but at a slow rate determined by the values of resistor 53 and capacitor 54. The charge on capacitor prevents the multivibrator from resetting and the Q output remains high. If three consecutive horizontal pulses are missed, the capacitor 54 is discharged to a level permitting the multivibrator 29 to reset and the Q output goes low. The low on the line 33 causes the output of the NAND Gate 32 to go high and turn transistor Q2 on and discharge the capacitor 37 to a level determined by the Zener diode 43. The level, such as 10 volts, established by the Zener diode 43 is the maximum voltage to the control input lead 16 and thus also sets the maximum voltage on the output line 14. The next horizontal synchronization pulse will recharge the capacitor 54 to reset the multivibrator 29 and return the NAND Gate 32 and the transistor Q2 to the normal state.

The failure of either the power supply 11 or the voltage regulator 27 will cause lines 28 and 31 to go low and, the output of the NAND Gate 32 to go high and turn on the transistor Q2 and discharge capacitor 37 through the Zener diode 43 to hold the voltage applied to the control input lead 16 at the selected voltage. Thus the multivibrator 29 and the NAND 32 in cooperation with the transistors Q1 and Q2 prevent the output level of the voltage regulators 13 from raising when a power supply fails or when a consecutive series of synchronization is missing.

What is claimed is:

1. A protection and pulse heating circuit for a line cathode in a flat panel display device, comprising:

an adjustable voltage regulator for providing a regulated output voltage having a selected level, said adjustable voltage regulator having a control input lead whereby said output voltage is regulated by the voltage on said control input lead;

control circuit means for controlling said voltage on said control input lead, said control circuit means including voltage responsive avalanche discharge means and charge storage means, said charge storage means being charged by said output voltage for controlling the voltage on said control input lead;

logic means for actuating said control circuit means in response to the horizontal synchronization pulses of said display device whereby said charge storage means is discharged by said avalanche discharge means in response to said logic means; and pulse generator means responsive to said output voltage whereby said pulse generator means pulse heats said cathode in accordance with said horizontal synchronization pulses.

2. The circuit of claim 1 wherein said logic circuit means includes multivibrator means responsive to said synchronization pulses and dual input gate means responsive to said multivibrator means whereby said gate means actuates said control circuit means.

3. The circuit of claim 2 wherein said pulse generator means includes second charge storage means for storing said output voltage, and second voltage responsive avalanche discharge means responsive to said synchronization pulses whereby said second charge storage means pulse heats said cathode in response to said output voltage and said sync pulses.

4. The circuit of claim 1 wherein said pulse generator means includes second charge storage means for storing said output voltage, and second voltage responsive avalanche discharge means responsive to said synchronization pulses whereby said second charge storage means pulse heats said cathode in response to said output voltage and said sync pulses.

5. The circuit of claim 4 wherein said logic circuit means includes multivibrator means responsive to said synchronization pulses and dual input gate means responsive to said multivibrator means whereby said gate means actuates said control circuit means.

6. The circuit of claim 1 wherein said logic circuit means includes multivibrator means responsive to said synchronization pulses and dual input gate means responsive to said multivibrator means whereby said gate means actuates said control circuit means.

* * * * *

UNITED STATES PATENT AND TRADEMARK OFFICE

CERTIFICATE OF CORRECTION

PATENT NO. : 4,464,611

DATED : August 7, 1984

INVENTOR(S) : Jacob Paul Hasili

It is certified that error appears in the above-identified patent and that said Letters Patent is hereby corrected as shown below:

Column 1, line 44, "of" should be --for--.

Column 2, line 62, "32", second occurrence, should be --33--.

Column 5, line 55, "regulators" should be --regulator--.

Signed and Sealed this

*Twenty-fifth* Day of *December 1984*

[SEAL]

*Attest:*

*Attesting Officer*

GERALD J. MOSSINGHOFF

*Commissioner of Patents and Trademarks*